United States Patent [19]

Cast

[11] Patent Number: 4,625,597

[45] Date of Patent: Dec. 2, 1986

[54] SCREW DRIVING APPARATUS

[75] Inventor: Adolf Cast, Lenningen, Fed. Rep. of Germany

[73] Assignee: Karl M. Reich Maschinenfabrik GmbH, Nuertingen, Fed. Rep. of Germany

[21] Appl. No.: 650,095

[22] Filed: Sep. 13, 1984

[30] Foreign Application Priority Data

Sep. 16, 1983 [DE] Fed. Rep. of Germany ..... 3333427

[51] Int. Cl.[4] ..... B25B 23/02; B25B 23/04; B25B 23/06

[52] U.S. Cl. ..... 81/57.37; 81/57.3; 81/429; 81/470

[58] Field of Search ..... 81/57.3, 57.37, 429, 81/470

[56] References Cited

U.S. PATENT DOCUMENTS 3,642,039 2/1972 McGee ..... 81/470
4,043,365 8/1977 York ..... 81/429
4,354,403 10/1982 Boegel et al. ..... 81/57.37
4,404,877 9/1983 Mizuno et al. ..... 81/57.37
4,442,738 4/1984 Spencer ..... 81/470

FOREIGN PATENT DOCUMENTS 2641828 3/1978 Fed. Rep. of Germany .

*Primary Examiner*—Frederick R. Schmidt
*Assistant Examiner*—Bradley I. Vaught
*Attorney, Agent, or Firm*—W. G. Fasse; D. H. Kane, Jr.

[57] ABSTRACT

A screw driving apparatus has a housing (1) for the drive system and a hollow screw guide member (2) rigidly secured to the housing (1). A screw driver blade (5) is axially displaceable in the hollow screw guide member and relative to a drive motor forming part of the drive system. This arrangement of the components results in a compact short structure with a handle located near the center of gravity of the structure. Hence, the apparatus can be operated by one hand only and an operator has his other hand free, for example, to hold a work piece (7).

7 Claims, 4 Drawing Figures

SCREW DRIVING APPARATUS

FIELD OF THE INVENTION

The invention relates to a screw driving apparatus having a housing and a drive motor mounted in the housing. A hollow screw guide member is operatively secured to the housing. A screw driver blade is rotatably and axially displaceably supported in the hollow screw guide member. A screw supply magazine is arranged for cooperation with the hollow screw guide member.

DESCRIPTION OF THE PRIOR ART

German Pat. No. (DE-PS) 2,641,828 discloses a screw driving apparatus as mentioned above. The known apparatus is capable of driving screws into a work piece which are supplied into the driving apparatus in the form of a strip holding a plurality of screws. These screws held by the strip are supplied from a magazine into the hollow screw guide member by a screw supply device. The hollow screw guide member also referred to as guide foot is displaceably arranged on a drive motor equipped with a screw driver blade. In this type of arrangement, the operator must manually displace the drive motor against the guide foot while simultaneously overcoming a biasing spring action when driving a screw into a work piece. This feed advance movement simultaneously activates the screw supply device.

Due to the arrangement of the guide foot on the drive motor a relatively long structure results. Moreover, the handle of the apparatus is generally arranged at the rear end of the apparatus so that the handle is located at a substantial distance from the center of gravity of the entire apparatus. Thus, in order to hold the known screw driving apparatus securely while operating the same, especially when driving screws into vertical walls and overhead ceilings, it is necessary to hold and guide the apparatus with both hands. Additionally, the speed of work is determined by the feed advance to be performed manually and by the return stroke of the drive motor. Where such an apparatus has to be used for prolonged periods of time, fatiguing of the operator may occur.

OBJECTS OF THE INVENTION

In view of the above it is the aim of the invention to achieve the following objects singly or in combination:

to construct an apparatus of the type mentioned above in such a way that it may be held and operated with one hand only, while simultaneously permitting a high operational speed;

to avoid any relative movement between the drive motor and the hollow screw guide member or guide foot; and to locate the drive motor for the screw driver blade in the handle of the apparatus.

SUMMARY OF THE INVENTION

According to the invention the above objectives have been achieved in that the guide foot or hollow screw guide member is rigidly secured to the apparatus housing and in that the screw driving blade is supported in the housing in a displaceable manner relative to the drive motor. This type of structure is compact and short so that the handle may be located near the center of gravity of the entire apparatus rather than remote from the center of gravity as is the case in the prior art. Further, the particular coordination of components as taught by the invention makes it possible to construct the screw driving apparatus in a very light manner so that it is operable by one hand only and so that the other hand of the operator is free for holding, for example the work piece to be attached or the like. Further, the invention avoids any relative movement between the drive motor and the guide foot or hollow screw guide member. This feature in combination with an automatic performance of the feed advance and return stroke of the screw driving blade independently of the motion of the operator, increases the work speed that may be achieved with the present apparatus.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
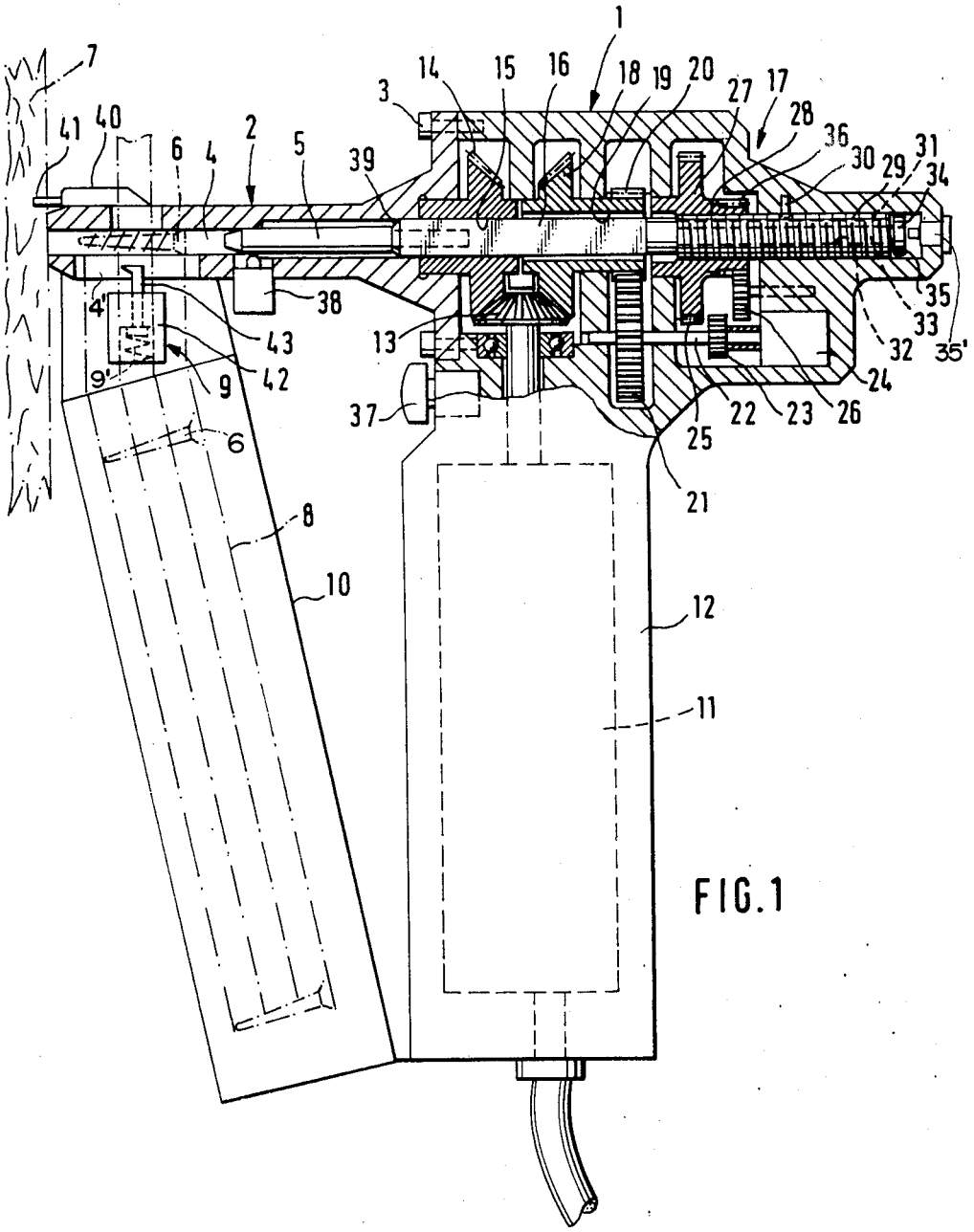
FIG. 1 shows a side view of the present apparatus, partially in section, with an electric drive motor arranged in the handle of the apparatus and extending with its longitudinal axis perpendicularly to the longitudinal axis of the screw driving blade.

FIG. 1 illustrates an embodiment of an apparatus according to the invention, wherein the screw driving apparatus comprises a guide foot 2 functioning as a hollow screw guide member which is rigidly secured to a housing 1 by housing screws 3. The hollow screw guide member 2 comprises a guide bore 4 arranged axially for guiding the screws 6 into a work piece 7 and for also guiding a screw driving blade 5. The screw driving blade 5 is axially displaceable for driving screws 6 into the work piece 7. These screws 6 form part of a spirally wound screw carrying strip 8 which is supplied into the guide bore 4 by a screw supply device 9 cooperating with a magazine 10 holding the screw strip 8. The supply device 9 moves the strip through an opening 4' into the guide bore 4 as is conventional.

An electric drive motor 11 mounted in the handle 12 of the housing 1 drives the screw driver blade 5 in an axial direction as well as in a rotational manner as will now be described. The longitudinal axis of the drive motor 11 is arranged at an angle, preferably at a 90° angle relative to the longitudinal axis of the screw driver blade 5. The drive motor 11 drives a bevel gear 13 which in turn meshes with two further bevel gears 14 and 18. The bevel gear 14 is mounted coaxially to the screw driver blade 5 in the housing 1 and has a central coaxial bore 15, for example, with a square cross-section. A correspondingly square engagement member 16 forming part of the screw driver blade 5 or a disconnectable extension thereof, is slidably received in the square bore 15. Thus, when the wheel 14 rotates, the blade 5 also rotates. The feed advance mechanism 17 for axially displacing the blade 5 comprises the mentioned bevel gear 18 also operatively mounted coaxially to the blade 5 in the housing 1 and also driven by the bevel gear 13. The central bore 19 of the bevel gear 18, however, has a diameter larger than the largest diameter of the engagement member 16 so that the engagement member 16 is freely movable back and forth in the axial direction.

The bevel gear 18 carries a pinion wheel 20 secured to the bevel gear 18. The pinion 20 in turn drives a gear wheel 21 rigidly mounted on a shaft 22. A coupling gear wheel 23 is axially displaceable back and forth along the shaft 22 by means of a magnet 24. As shown, the gear wheel 23 is in a neutral position. Thus, the gear wheel 23 may either engage a gear wheel 25 or an intermediate direction reversing gear wheel 26 cooperating with a pinion 36. The gear wheel 25 is part of a drive sleeve 27 having a central threaded bore 28 meshing with a threaded spindle 29 which is mounted for axial displacement in a bore of the housing 1 coaxially with the longitudinal axis of the blade 5, but restrained against rotation by a pin 30 reaching into a longitudinal groove 31 of the threaded spindle 29 and rigidly secured to the housing 1.

The threaded spindle 29 has a central bore 32 in which an extension 33 of the engagement member 16 of the blade 5 is received. The extension 33 carries at its rear end a flange 34 bearing or resting against the facing end surface 35 of the threaded spindle 29, whereby the blade 5 is operatively secured to the threaded spindle 29 so that the blade 5 may rotate relative to the spindle 29, but so that the blade 5 may be axially displaced when the spindle 29 is axially displaced in one or the other direction by the rotation of the gear wheel 25 or the gear wheel 26. The gear wheel 26 is supported in the housing for free rotation when it is disengaged from the coupling gear 23 or for driving the driving bushing 27 through the pinion 36.

The electrical components of the screw driving apparatus comprise further a switch 37 for activating the electrical drive motor 11 and a sensor switch 38 which cooperates with a shoulder 39 of the blade 5 or rather, the drive extension member 16 of the blade 5, whereby the switch 38 is operated when it encounters the shoulder 39 as will be described in more detail below. A work piece contact sensor switch 40 is attached to the lower end of the guide foot 2. The sensor switch 40 has a sensor pin 41 which is pushed back into the sensor switch 40 to activate the switch when the switch 2 contacts a work piece 7 for switching on the apparatus, or rather the drive motor.

The feed advance of the screw carrying strip 8 is accomplished with a screw supply device or means 9 provided with an electromagnet 42 for operating a feed advance finger 43 which cooperates or rather engages the screw carrying strip 8.

The apparatus shown in FIG. 1 operates as follows. The apparatus is switched on by operating the switch 37. As the motor 11 rotates the bevel gear 13 the latter rotates the two bevel gears 14 and 18, whereby the square bore 15 rotates the blade 5 through the extension 16 slidably received in the bore 15. The second bevel gear 18 drives through the pinion 20 and gear wheel 21 the coupling wheel 23. However, as long as the coupling gear 23 is in the intermediate position as shown, the drive sleeve 27 will remain stationary. Further, the threaded spindle 29 is prevented from rotating by the pin 30 although the extension 33 in the bore 32 of the threaded spindle 29 does rotate.

A screw 6 is present in the guide bore 4 and ready to be driven into the work piece 7. If now the apparatus contacts the work piece with the front end of the guide foot 2, the sensor pin 41 of the sensor switch 40 is operated, thereby activating the electromagnet 24 of the feed advance mechanism 17 which activates the coupling gear wheel 23 in such a manner that it is moved toward the gear wheel 25 and into engagement with the gear wheel 25. Thus, the feed advance sleeve 27 begins to rotate and the screw spindle 29 is axially displaced toward the work piece 7, thereby automatically applying an axial force while simultaneously driving the screw 6 into the work piece. The feed advance in the axial direction and the rotation may continue simultaneously, for example, until the top surface of the screw head extends flush with the surface of the work piece 7. At this moment the shoulder or contact surface 39 of the blade 5 operates the sensor switch 38 which now causes the reversal of the electromagnet 24 and also an activation of the electromagnet 42 for feeding the next screw into the bore 4 when the blade 5 is sufficiently retracted.

The blade 5 is retracted by the switch over of the electromagnet 24 which now moves the coupling wheel 23 toward and into engagement with the intermediate gear wheel 26 which is thus driven by the coupling wheel 23 and which thereby drives the drive sleeve 27 through the pinion 36 in the opposite direction so that the blade 5 is axially withdrawn with the aid of the threaded spindle 29 until the blade 5 reaches its rest position. If desired, an end sensor switch 35' may be provided for stopping the retraction movement of the blade 5, whereby the electromagnet 24 would again move the coupling wheel 23 into the disengaged position shown in FIG. 1.

When the guide foot 2 engaged the work piece 7 the electromagnet 42 of the screw supply device 9 was activated by the sensor switch 40, 41 in such a manner that the feed advance finger 43 was withdrawn away from the bore 4 and opening 4' against the force of a spring 9'. After the blade 5 reaches its end position at the end of the return stroke, the sensor switch 35' will switch off the electromagnet 42 so that the spring 9' drives the feed advance finger 43 and thus the next screw of the screw carrying strip 8 into the bore 4. Thus, the apparatus is ready for the next screw driving operation.

Figure 2:
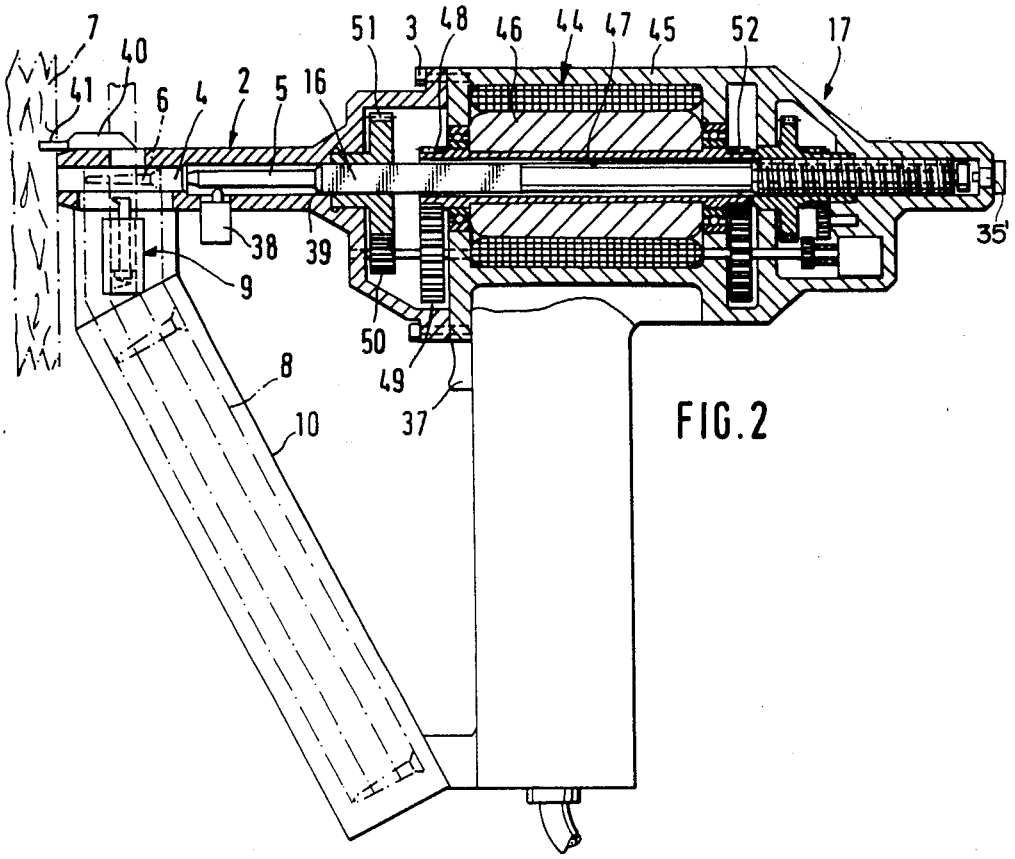
FIG. 2 is a view similar to that of FIG. 1, however, showing the drive motor arranged coaxially with its longitudinal axis relative to the longitudinal axis of the screw driving blade.

FIG. 2 illustrates a further example embodiment of a screw driving apparatus according to the invention in which the electrical drive motor 44 is arranged concentrically relative to the axis of the screw driving blade 5 in a housing 45. The guide foot, the magazine 10, and the feed advance device 17 are substantially the same as in the embodiment of FIG. 1. In the embodiment of FIG. 2, the armature 46 of the drive motor 44 has a central bore 47 through which the blade 5 extends. The operation of the blade 5 is accomplished with a pinion gear wheel 48 connected to the armature 46. The pinion wheel 48 drives a blade drive wheel 51 through intermediate gear wheels 49 and 50. The blade drive wheel 51 engages the square extension 16 of the blade 5 for driving the blade 5 as described above. A second pinion 52 also connected to the armature 46, operates the feed advance mechanism 17 for shifting the blade 5 axially back and forth, also as has been described above. Thus, the function of the embodment of FIG. 2 is substantially the same as the function of the embodiment of FIG. 1.

Figure 3:
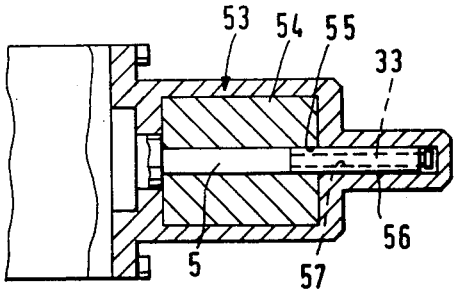
FIG. 3 shows, partially in section, a modification of the feed advance mechanism for the screw driving blade.

FIG. 3 shows the use of a blade feed advance mechanism 53 with an electromagnet 54 for axially driving the blade 5 back and forth. The mechanism 53 takes the place of the gear drive means 17 shown in FIGS. 1 and 2. An iron core or armature 56 is axially movable in a central bore 55 of the electromagnet 54. The core 56 has a central bore 57 into which the extension 33 of the blade 5 reaches. Here again the electromagnet 54 may be activated by the sensor switch 40 so that it moves the blade 5 against the bias of a spring not shown toward the work piece 7. After the electromagnet 54 is switched off, the spring will return the blade 5 into the rearward rest position. For example, the spring may be arranged around the extension 33 and bear against the rear flange of the extension 33.

Figure 4:
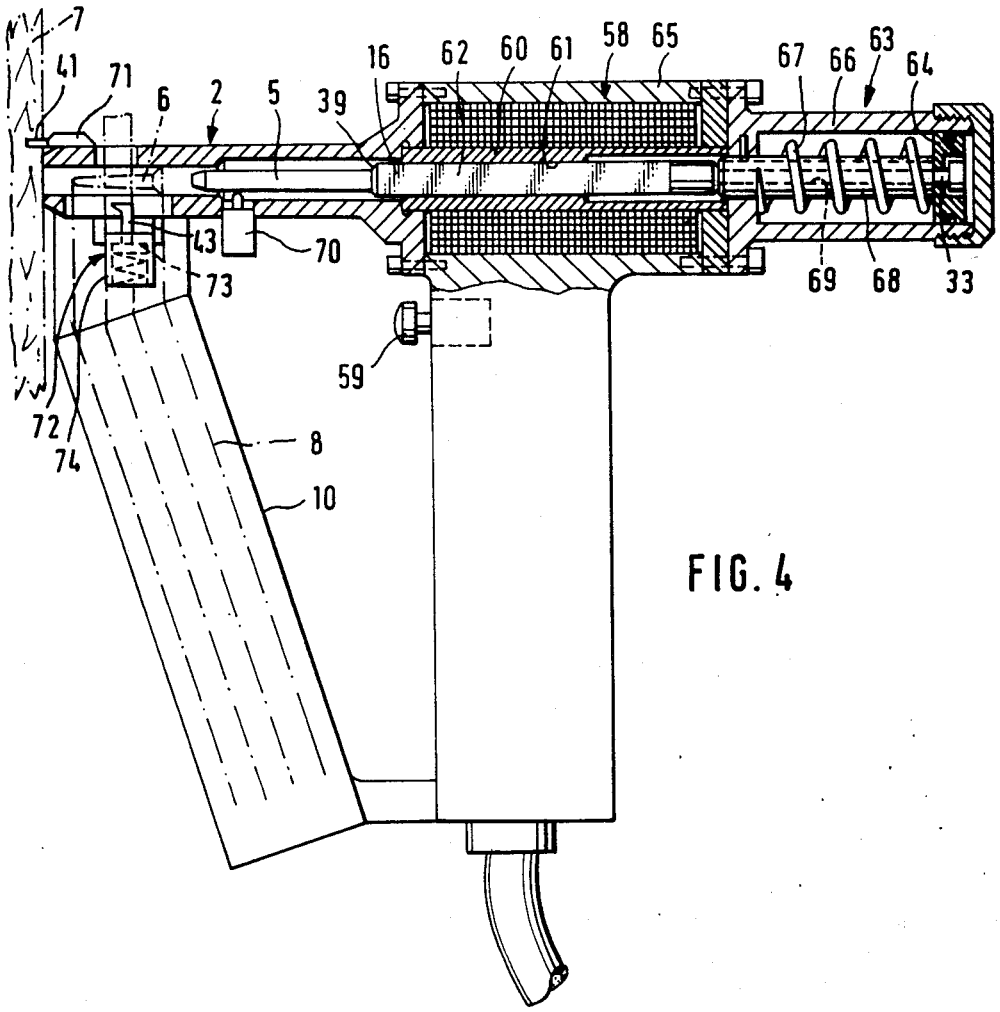
FIG. 4 is a view similar to FIG. 1, however, illustrating an embodiment in which the drive means for the screw driving blade comprise a pneumatic drive motor arranged coaxially with the longitudinal axis of the screw driving blade.

In FIG. 4 the drive of the screw driver blade 5 is accomplished by an air pressure operated pneumatic drive motor 58 which is switched on and off by a switching valve 59. The bearing sleeve 60 comprises, as in the example embodiment of FIG. 2, a central bore 61 in which the blade 5 is operatively supported for an axial back and forth movement. At the front end the bearing sleeve 60 is provided with an engagement section 62 having a square cross-section, for example. This square cross-section receives the engagement member 16 of the blade 5 also having the square cross-section as mentioned.

A feed advance piston 64 operates as feed advance mechanism 63 for the blade 5. The piston 64 is supported by a feed advance cylinder 66 in the housing 65 for axial displacement against the bias force of a compression spring 67. The piston 64 comprises a sleeve 68 with a bore 69 through which the extension 33 of the blade 5 reaches. The sensor switch 70 and the work piece engagement sensor 71 as well as the screw supply device 72 are all constructed in this embodiment as air pressure operated valves or pistons.

The operation of the embodiment of FIG. 4 by means of air pressure is accomplished in a manner analog to that described above with reference to the other example embodiments. The feed advance piston 64 is controlled, however, by the work piece engagement sensor 71 in such a way that the feed advance cylinder 66 receives air under pressure in response to movement of the sensor pin 41 into the sensor 71, whereby the feed advance piston 64 drives the blade 5 toward the work piece 7. When the screw driving operation is completed the blade 5 may be returned into its rest position by venting the feed advance cylinder 66 so that the feed advance piston 64 and thus the blade 5 are returned into the retracted rest position by the force of the compression spring 67.

The screw supply device 72 in this embodiment comprises a screw supply piston 73 which is displaceably supported in a screw supply cylinder against the bias of a spring. The screw supply piston 73 may also be controlled as described above through the workpiece engaging sensor 71.

Although the invention has been described with reference to specific example embodiments, it will be appreciated, that it is intended, to cover all modifications and equivalents within the scope of the appended claims.

What is claimed is:

1. A screw driving apparatus, comprising housing means, an electrical drive motor in said housing means, a hollow screw guide member, screw supply means operatively secured to said hollow screw guide member for feeding screws into said hollow screw guide member, a screw driver blade operatively movable in said hollow screw guide member, first mouting means (3) rigidly securing said hollow screw guide member to said housing means, second mouting means slidably mounting said screw driver blade in said housing means for displacement relative to said electrical drive motor, coupling means operatively interconnecting said electrical drive motor to said screw driver blade for driving said screw driver blade, said coupling means comprising first coupling members for rotating said screw driver blade and second coupling members for axially displacing said screw driver blade, and wherein said second coupling members for axially displacing said screw driver blade comprise a screw jack, connector means operatively securing said screw jack in a force transmitting manner to said screw driver blade, and feed advance drive means operatively interconnecting said electrical drive motor to said screw jack for axially displacing said screw jack and thus said screw driver blade.

2. The apparatus of claim 1, wherein said screw driver blade has a longitudinal axis, said electrical drive motor also having a longitudinal axis, said longitudinal axes extending perpendicularly to each other.

3. The apparatus of claim 1, wherein said feed advance drive means comprise gear means operatively arranged for advancing said screw jack in one or the opposite axial direction of said screw driver blade, said gear means including a shiftable gear wheel and means for shifting said gear wheel for moving said screw jack in one or the other axial direction.

4. The apparatus of claim 1, further comprising electromagnetic means operatively connected to said screw supply means for operating said screw supply means and feeding screws into said hollow screw guide means.

5. The apparatus of claim 1, wherein said motor means have a longitudinal axis and a longitudinal bore coaxial with said longitudinal axis, said screw driver blade being operatively received in said longitudinal bore.

6. The apparatus of claim 1, further comprising operating means connected to said screw supply means for feeding screws into said hollow screw guide means, sensor means (38, 70) connected to said operating means and located for sensing a specific position of said screw driver blade in said hollow screw guide member, said screw driver blade having means (39) for activating through said sensor means (38, 70) said operating means to supply a screw into said hollow screw guide member.

7. The apparatus of claim 1, further comprising sensor means located for sensing a contacting of a work piece by said apparatus, said sensor means being arranged for activating said motor means.

* * * * *